US005660385A

United States Patent [19]

Furlani et al.

[11] Patent Number: 5,660,385

[45] Date of Patent: Aug. 26, 1997

[54] APPARATUS FOR DIVERTING A PHOTOCOPYING MEDIUM IN PHOTOCOPIES

[75] Inventors: Edward P. Furlani, Lancaster; John C. Fournier, Depew, both of N.Y.

[73] Assignee: Eastman Kodak Company, Rochester, N.Y.

[21] Appl. No.: 570,303

[22] Filed: Dec. 11, 1995

[51] Int. Cl.[6] ..... B65H 39/10

[52] U.S. Cl. ..... 271/303; 198/370.13

[58] Field of Search ..... 271/303, 304, 271/305; 198/439, 370.13

[56] References Cited

U.S. PATENT DOCUMENTS

| | | | |
|---|---|---|---|
| 2,076,700 | 4/1937 | Bryce | 271/64 |
| 3,788,636 | 1/1974 | Rehm et al. | 271/305 |
| 4,237,466 | 12/1980 | Scranton | 346/75 |
| 4,277,061 | 7/1981 | Nagel et al. | 271/303 |
| 4,518,161 | 5/1985 | Nakamura | 271/303 |
| 5,392,092 | 2/1995 | Laidlaw et al. | 355/24 |
| 5,484,140 | 1/1996 | Hirose et al. | 271/175 |

FOREIGN PATENT DOCUMENTS

| | | | |
|---|---|---|---|
| 2724387 | 12/1978 | Germany | 271/303 |
| 404023763 | 1/1992 | Japan | 271/303 |
| 404064567 | 2/1992 | Japan | 271/303 |

*Primary Examiner*—H. Grant Skaggs
*Attorney, Agent, or Firm*—Peyton C. Watkins

[57] ABSTRACT

An apparatus for diverting paper along at least two paper paths in photocopiers, the apparatus comprises a paper diverter for diverting paper from one path to another path. A magnet is attached to and moves the paper diverter which movement, in turn, permits the paper to be directed from one path to another paper path. Means for creating a magnetic field interacts with the magnet for permitting the magnet to move in response to the magnetic field for enabling the magnet to move the paper diverter for ultimately permitting paper re-direction.

7 Claims, 1 Drawing Sheet

APPARATUS FOR DIVERTING A PHOTOCOPYING MEDIUM IN PHOTOCOPIES

FIELD OF THE INVENTION

The invention relates generally to the field of paper diverter systems in photocopiers and, more particularly, to such paper diverter systems in photocopiers which reduce the use of mechanical parts for reducing mechanical failure due to such mechanical parts.

BACKGROUND OF THE INVENTION

Photocopiers typically contain paper diverter systems which divert paper through different paper paths for permitting two-sided copying and other functions, as is well known in the art. These paper diverter systems include a C-shaped paper diverter which passes the paper into its bottom portion, along its curved interior portion, and out of its top portion for defining a first paper path. A solenoid plunger is attached to the paper diverter for moving the paper diverter so that the paper passes beneath and substantially undisturbed by the paper diverter and along a second paper path.

The solenoid includes a housing having a hollowed-out portion into which a mechanical plunger is inserted upon energizing a coil in the housing, and retracted upon de-energizing the coil. A pivot arm is attached to the plunger at one end and to the paper diverted at its other end for moving the paper diverter simultaneously with the plunger for permitting the above-described movement of the paper diverter. A spring is also attached to the pivot arm for forcing the plunger and in turn, the paper diverter to its first paper path position when the coil is de-energized.

As is obvious to those skilled in the art, when the paper diverted is in the first paper-path position, the coil is de-energized and the spring forces the paper diverter, via the plunger, into the first paper-path position. To position the paper diverter into the second paper-path position, the coil is energized for forcing the plunger into the housing which ultimately forces the paper diverter into the second paper-path position.

Although the presently known and utilized apparatus is satisfactory, it is not without drawbacks. The insertion and retraction of the plunger into and out of the plunger create an undesirable lateral motion which forces the plunger against the interior portion of the housing. This obviously creates mechanical failure after repeated insertions and retractions.

Consequently, a need exists for an improved paper diverter system in photocopiers which eliminates plunger-like devices for reducing mechanical failure.

SUMMARY OF THE INVENTION

The present invention is directed to overcoming one or more of the problems set forth above. Briefly summarized, the invention resides in an apparatus for diverting paper along at least two paper paths in photocopiers, the apparatus comprising: (a) a paper diverter for diverting paper from one path to another path; (b) a magnet attached to and moving said paper diverter which movement, in turn, permits the paper to be directed from one path to another; and (c) means for creating a magnetic field which interacts with said magnet for permitting said magnet to move in response to the magnetic field for enabling said magnet to move said paper diverter for ultimately permitting paper redirection.

It is an object of the present invention to provide a paper diverter system in photocopiers which eliminates plunger-like devices for reducing mechanical failure.

It is a feature of the present invention to provide a magnet attached to and moving the paper diverter which movement, in turn, permits the paper to be directed from one path to another paper path.

The above and other objects of the present invention will become more apparent when taken in conjunction with the following description and drawings wherein identical reference numerals have been used, where possible, to designate identical elements that are common to the figures.

BRIEF DESCRIPTION OF THE DRAWINGS

In the course of the following detailed description, reference will be made to the attached drawings in which.

DETAILED DESCRIPTION OF THE INVENTION

Figure 1:
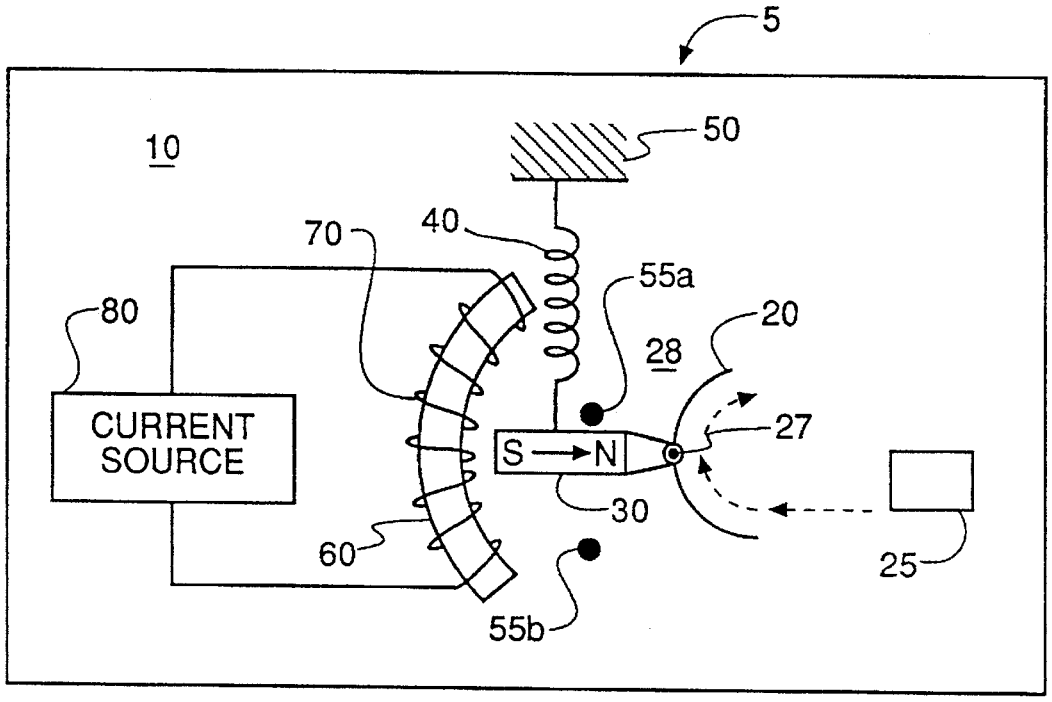
FIG. 1 is a schematic diagram of an apparatus of the present invention which moves a paper diverter for paper re-direction.
Figure 2:
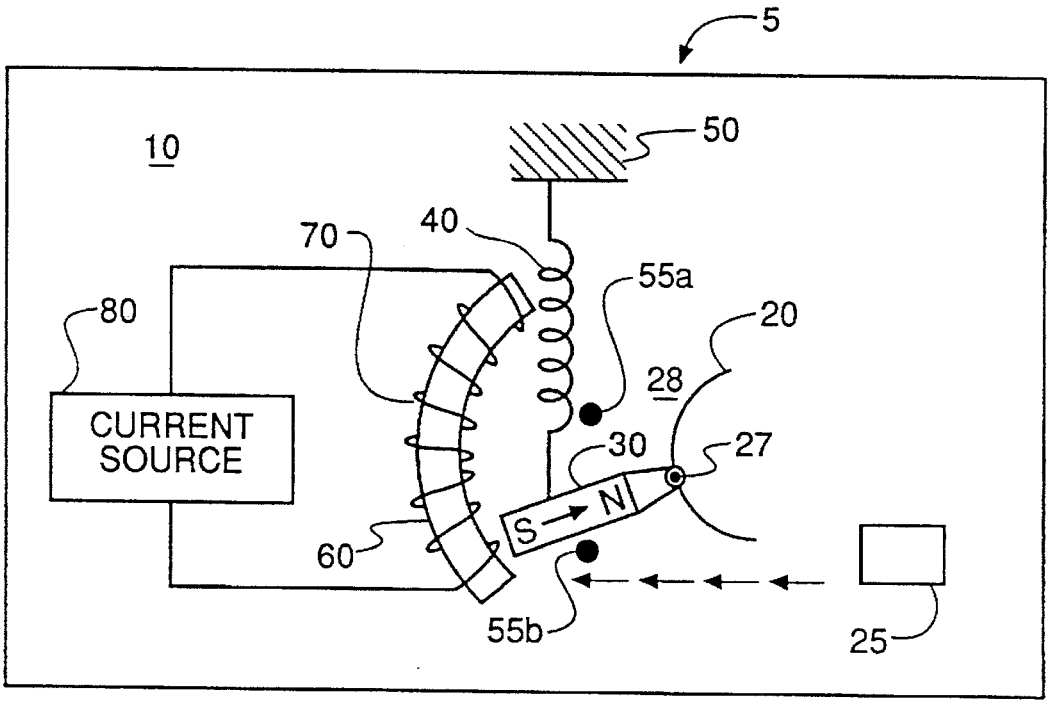
FIG. 2 is a schematic diagram illustrating a second position of the apparatus of FIG. 1.

Referring to FIG. 1, there is illustrated a photocopier 5 having a paper diverter system 10 of the present invention which includes a C-shaped paper diverter 20 for diverting a photocopying medium, such as paper 25, either along a first paper path illustrated by the dashed arrows, or along a second paper path illustrated by the solid arrows (see FIG. 2). A bar 27 is pivotably mounted to a wall 28 of the photocopier 5 at one end of its ends for permitting rotation about the longitudinal axis of the bar 27. The bar 27 extends outwardly from the wall 28 for permitting the paper diverter 20 to be rigidly attached to its center portion, via a suitable attachment such as a weldment (not shown). A bi-polar magnet 30, which obviously includes a north and south pole, is rigidly attached to the other end of the bar 27, also via a suitable attachment such as a weldment (not shown), for inducing movement to the paper diverter 20. For clarity, it is instructive to note that any upwardly or downwardly motion of the south pole portion of the magnet 30 causes the bar 27 to rotate about its longitudinal axis which, in turn, causes the paper diverter 20 to tilt either upwardly or downwardly. A spring 40 is mounted to a rigid structure 50, such as a wall, for exerting an upward force on the magnet 30 which maintains the magnet 30 in a generally horizontal position. A first stop 55*a* is disposed adjacent the magnet for preventing movement of the magnet 30 beyond the stop 55*a* as the spring exerts its upward force. A second stop 55*b* also rests adjacent the magnet 30 for preventing movement of the magnet 30 beyond it in the opposite direction when a magnetic field is exerted on the magnet, which is described later in detail.

An arcuate-shaped bar 60, which includes a coil 70 wrapped around it, is placed adjacent the south pole of the magnet 30 for creating a magnetic field when a current, which is created by a current source 80, is passed through the coil 70. When the coil 70 is de-energized, the spring 40 keeps the magnet in the position illustrated in FIG. 1, and the magnet rests against the stop 55*a*. The magnet 30, in turn, causes the paper diverter 20, via the bar 27, to maintain its downwardly position so that the paper 25 passes into the paper diverter 20 as illustrated by the dashed arrows.

Referring now to FIG. 2, to pass the paper along the second paper path (illustrated by the solid arrows), current is passed through the coil 70 so that a south pole is created on the top portion of the bar 60 and a north pole on the lower portion of the bar 60. The south pole of the bar 60 repels the south pole of the magnet 30, and the north pole of the bar 60 attracts the south pole of the magnet for causing the magnet to rest in the position shown in FIG. 2. This causes the magnet 30 to pivot the bar 27 which, in turn, tilts the paper diverter 20 upwardly so that the paper 25 may pass beneath the paper diverter 20 as illustrated by the solid arrows. The stop 55*b* prevents movement of the magnet 30 beyond it as the magnetic field is exerted on the magnet 30. To return to the first paper path, the coil is simply de-energized as is described above in detail.

As is obvious to those skilled in the art, the polarity of the magnet 30 may be reversed so that the portion which is adjacent the bar 60 is the north pole, and the south pole of the magnet 30 is placed adjacent the paper diverter. In this case, current is passed through the coil 70 so that the polarity of the top portion of the bar 60 is north and the bottom portion is the south for causing the above described movement of the magnet 30 and, consequently, movement of the paper diverter 20.

The invention has been described with reference to a preferred embodiment. However, it will be appreciated that variations and modifications can be effected by a person of ordinary skill in the art without departing from the scope of the invention.

Parts List

5 photocopier
10 paper diverter system
20 paper diverter
25 paper
27 rotation member
28 wall
30 magnet
40 spring
50 wall
55*a* Stop
55*b* stop
60 flux bar
70 coil
80 current source

We claim:

1. An apparatus for diverting a photocopying medium along at least two paths in photocopiers, the apparatus comprising:

(a) a diverter for diverting the photocopying medium from one path to another path;

(b) a rod pivotably attached to the apparatus and rigidly attached to said diverter;

(c) a bar magnet having two ends one of which attaches to and moves said rod which movement, in turn, rotates said diverter for permitting the photocopying medium to be directed from one path to another path; and (d) means for creating a magnetic field which interacts with said magnet for permitting said magnet to move in response to or lack of the magnetic field for enabling said magnet to move said paper diverter for ultimately permitting re-direction of the photocopying medium.

2. The apparatus as in claim 1 further comprising a spring attached to said magnet for respectively returning both said magnet and, in turn, the paper diverter to predetermined positions when said magnetic field creating means is de-activated.

3. The apparatus as in claim 2, wherein said magnet is bi-polar.

4. The apparatus as in claim 3 further comprising a current source for providing a current to said magnetic field means.

5. The apparatus as in claim 2 further comprising a stop for preventing movement of said magnet beyond a predetermined location.

6. The apparatus as in claim 1, wherein said paper diverter is generally arcuate shaped.

7. The apparatus as in claim 2 wherein said magnetic field means includes a bar having a coil wrapped around a portion of said bar.

* * * * *